US005558199A

United States Patent [19]

Roether et al.

[11] Patent Number: 5,558,199

[45] Date of Patent: Sep. 24, 1996

[54] APPARATUS FOR FORMING A LAYER OF TOBACCO PARTICLES

[75] Inventors: Friedemann Roether, Aumühle; Heiko Niehues, Hamburg; Uwe Leckband, Hamburg; Harry Drewes, Hamburg; Horst-Udo Christ, Hamburg; Hans Dierken, Amelinghausen, all of Germany

[73] Assignee: Hauni Maschinenbau Aktiengesellschaft, Hamburg, Germany

[21] Appl. No.: 278,056

[22] Filed: Jul. 20, 1994

[30] Foreign Application Priority Data

Jul. 31, 1993 [DE] Germany ..... 43 25 838.7
Oct. 16, 1993 [DE] Germany ..... 43 35 385.1

[51] Int. Cl.[6] ..... B65G 47/31

[52] U.S. Cl. ..... 198/461.2; 198/614; 198/771

[58] Field of Search ..... 198/461.1, 461.2, 198/461.3, 610, 614, 626.1, 771

[56] References Cited

U.S. PATENT DOCUMENTS

| | | | |
|---|---|---|---|
| 2,402,183 | 6/1946 | Rowe et al. | 198/771 X |
| 2,819,788 | 1/1958 | Howard | 198/461.1 X |
| 2,833,389 | 5/1958 | Bergmann | 198/771 X |
| 3,908,814 | 9/1975 | Hieronymus | 198/461.2 |
| 4,244,382 | 1/1981 | Thiele et al. | 198/771 X |
| 4,457,840 | 7/1984 | Nagl | 198/771 X |
| 4,502,615 | 3/1985 | Stangl | 198/771 X |
| 4,936,489 | 6/1990 | Blain et al. | 198/771 X |

*Primary Examiner*—D. Glenn Dayoan
*Attorney, Agent, or Firm*—Darby & Darby, P.C.

[57] ABSTRACT

An apparatus for manipulating a multilayer stream of tobacco particles with randomly intermixed foreign particles has a vibratory conveyor which advances the stream toward and discharges successive increments of the stream onto the upper reach of an endless belt or chain serving to advance the increments at a speed exceeding the speed of advancement of the stream by the vibratory conveyor. The endless belt or chain discharges a single layer of tobaco particles and foreign particles, and such single layer is caused to move past a segregating unit which detects and expels foreign particles therefrom.

23 Claims, 3 Drawing Sheets

APPARATUS FOR FORMING A LAYER OF TOBACCO PARTICLES

BACKGROUND OF THE INVENTION

The invention relates to improvements in apparatus for transporting tobacco particles, and more particularly to improvements in apparatus for converting a multilayer stream or flow of tobacco particles into a single layer or carpet of such particles. Still more particularly, the invention relates to improvements in apparatus for converting a continuous stream or flow of tobacco particles into a formation in which all or practically all of the particles are exposed.

As used herein, the term single layer (or monolayer) is intended to denote a flow of tobacco particles (such as strips, ribs and like tobacco fragments) which were obtained as a result of prior treatment and processing of tobacco leaves and are to be transported in the form a stratum wherein at least a large majority of particles are disposed next to, rather than above, each other.

The transformation of a multilayer stream or flow of tobacco particles into a single layer is a prerequisite for satisfactory treatment prior to conversion of the flow into a rod which is normally trimmed to form a rod-like filler ready to be draped into a web of cigarette paper or other suitable wrapping material. The thus obtained wrapped filler is ready to be subdivided into plain cigarettes, cigars or other rod-shaped articles of the tobbaco processing industry.

The treatment of the single layer of tobacco particles prior to conversion into a rod-like filler normally includes or can include sifting, spraying an additive onto the single flow, and particularly scanning for the purpose of detecting and expelling foreign particles including fragments of metal, rock or the like. The scanning normally involves monitoring the single layer with one or more photoelectronic detectors. Detection and expulsion of all foreign particles should be completed at an early stage of tobacco processing in order to ensure that the foreign particles cannot interfere with predictable treatment of tobacco. For example, a fragment of metal or rock is likely to make a hole in the wrapping material and to thus affect the appearance as well as the quality of the ultimate product, such as a plain or filter tipped cigarette, cigar, cigarillo or the like.

Another important prerequisite for satisfactory treatment prior to conversion of a stream of tobacco particles into a rod-like filler is that the single layer should be advanced at a rate which is necessary to satisfy the requirements of modern high-speed machines, e.g., cigarette makers which turn out up to and in excess of 14,000 articles per minute.

If the monitoring of a rapidly advancing layer of tobacco particles is to result in the detection of all or practically all foreign particles, each and every article of the layer should be detectable by an optoelectronic detector. Problems arise if the particles of the layer overlie each other because the subivision of tobacco leaf laminae (i.e., tobacco leaves which were relieved of ribs) results in the making of so-called strips the shape and the dimensions of which often closely approximate or match the shape and size of certain foreign particles. The heretofore known apparatus for the conversion of a continuous multilayer stream of tobacco particles into a single layer wherein satisfactory particles are in random distribution with undesirable foreign particles and all particles can be detected by presently known monitoring devices are incapable of satisfying the above outlined requirements, primarily because a relatively large percentage of particles is overlapped and thus concealed from view by the neighboring particles.

OBJECTS OF THE INVENTION

An object of the invention is to provide a novel and improved apparatus for conversion of a multilayer stream or flow of tobacco particles into a single layer wherein the particles are readily detectable by presently available monitoring means.

Another object of the invention is to provide the apparatus with novel and improved conveyors.

A further object of the invention is to provide a novel and improved combination of conveyors for use in the improved apparatus.

An additional object of the invention is to provide a novel and improved method of transferring tobacco particles from a preceding conveyor onto a next-following conveyor.

Still another object of the invention is to provide a novel and improved apparatus for spreading out a multilayer stream or flow of tobacco particles in several directions.

A further object of the invention is to provide a novel and improved vibratory conveyor for use in the above outlined apparatus.

Another object of the invention is to provide a novel and improved combination of belt or chain conveyors for use in the above outlined apparatus.

An additional object of the invention is to provide a tobacco distributor or hopper which embodies an apparatus of the above outlined character.

Still another object of the invention is to provide a machine for the making of cigarettes or other rod-shaped articles of the tobacco processing industry which embodies the above outlined apparatus.

A further object of the invention is to provide an apparatus which can ensure the segregation of all or nearly all undesirable foreign particles from a continuously moving flow of randomly distributed tobacco particles and undesirable foreign particles.

SUMMARY OF THE INVENTION

A feature of the present invention resides in the provision of an apparatus for transforming a multilayer stream of tobacco particles, which may but need not always contain randomly distributed foreign particles, into a single layer during advancement of the particles in a predetermined direction along an elongated path. The apparatus comprises a first transporting unit including at least one first conveyor having means for advancing the particles at a first speed along a first portion of the path, and a second transporting unit including at least one second conveyor having means for advancing the particles at a different second speed along a second portion of the path.

The at least one second conveyor can be, and preferably is, located downstream of the at least one first conveyor and the second speed (of advancing the particles downstream of the at least one first conveyor) preferably exceeds the first speed.

If the at least one first conveyor is located upstream of the at least one second conveyor and the speed of advancement of tobacco particles along the first portion of the path is less than the speed of tobacco particle along the second portion of the path, the at least one first conveyor preferably constitutes or includes or forms part of a vibratory conveyor.

If the at least one second conveyor is located downstream of the at least one first conveyor and the second speed exceeds the first speed, the at least one second conveyor can include at least one endless flexible element (such as an endless chain or an endless belt). It is presently preferred to assemble the improved apparatus in such a way that the at least one first conveyor is a vibratory conveyor and the at least one second conveyor is a belt or chain conveyor.

The vibratory conveyor is preferably provided with a multifaced outlet which delivers particles to the at least one second conveyor, particularly onto the upper run or stretch of an endless belt or chain of the at least one second conveyor. The outlet can comprise at least one first face, at least one second face downstream of the at least one first face, and at least one third face between the at least one first face and the at least one second face. It is presently preferred to provide the outlet of the vibratory conveyor with an array of faces extending substantially transversely of the predetermined direction. For example, the outlet can comprise a row of neighboring teeth or prongs the edge faces of which constitute the aforementioned array. The edge faces of the array can include edge faces which extend (at least substantially) in the predetermined direction and edge faces which extend transversely of such direction. Alternatively, or in addition to edge faces extending in and transversely of the predetermined direction, the array can include pairs of edge faces which converge toward each other in or counter to the predetermined direction.

It is also possible to design the outlet of the vibratory conveyor in such a way that it includes an edge face extending substantially transversely of the predetermined direction and a plurality of additional edge faces bounding openings or cutouts which are provided in the bottom wall of the vibratory conveyor upstream of the transversely extending edge face. The openings or cutouts can constitute a row which extends transversely of the predetermined direction upstream of the transversely extending edge face. At least some of the openings can have a substantially square or rectangular outline. Alternatively, at least some of the openings or cutouts can have a substatially triangular outline and each such opening is bounded by three edge faces two of which preferably converge toward each other in a direction counter to the predetermined direction.

The bottom wall of the vibratory conveyor can slope downwardly in the predetermined direction, and the vibratory conveyor preferably comprises means for varying the slope of the bottom wall within a selected range, preferably within a range of approximately 15° above and below a neutral position of the bottom wall. Furthermore, the bottom wall of the vibratory conveyor can be provided wit a plurality of steps which extend transversely of the predetermined direction to thus establish a cascading flow of particles along the respective portion of the path, i.e., along the first portion if the vibratory conveyor is installed upstream of the second transporting unit.

If the vibratory conveyor is installed upstream of the second transporting unit, the latter preferably comprises two second conveyors which are disposed above each other and define a channel (preferably a channel whose height decreases in the predetermined direction) for advancement of particles along the second portion of the path. Each of the second conveyors can include an endless flexible element (such as a chain or a belt). One of these elements includes an upper reach below and the other element includes a lower reach disposed above the channel. The second transporting unit preferably further comprises means for driving the endless flexible element of one second conveyor in synchronism with the flexible element of the other second conveyor.

The apparatus preferably further comprises means for segregating foreign particles from the single layer in a third portion of the path downstream of the first and second portions.

If the second portion of the path slopes downwardly (as seen in the predetermined direction) and is disposed downstream of the first portion, the apparatus can further comprise a third tranporting unit which is adjacent a substantially horizontal third portion of the path downstream of the second portion. The third transporting unit can comprise at least one third conveyor having means including at least one endless flexible element for advancing the particles at a third speed less than the second speed. The segregating means is then installed adjacent a fourth portion of the path downstream of the third portion.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
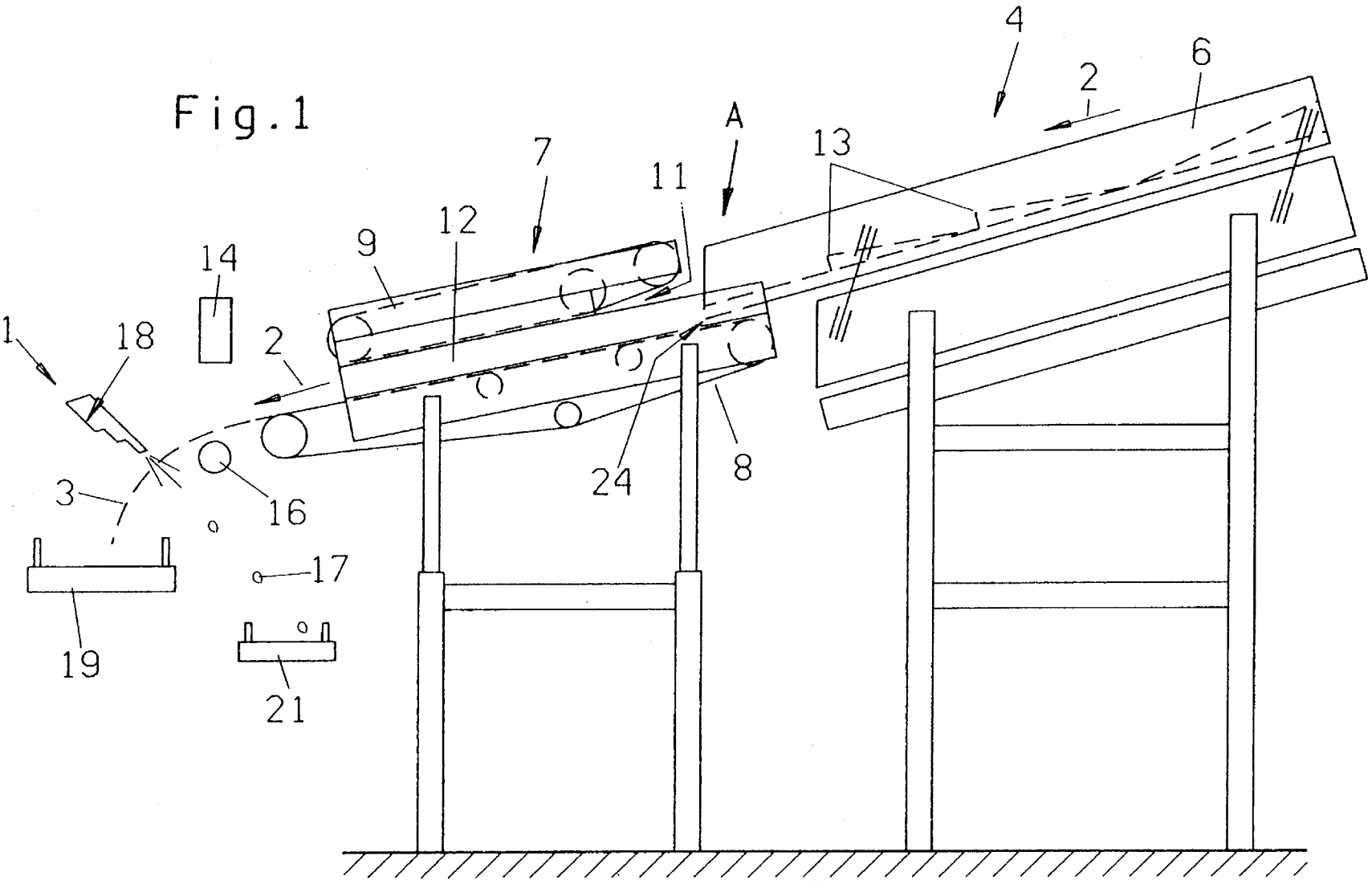
FIG. 1 is a schematic side elevational view of an apparatus which embodies one form of the present invention.

The apparatus which is shown in FIG. 1 comprises a first transporting unit 4 adjacent a first portion of an elongated path for a multilayer stream (not specifically shown) and a single layer 3 of a mixture of randomly distributed tobacco particles and foreign particles 17. A second transporting unit 7 is adjacent a second portion of the path downstream of the first unit 4 (as seen in the direction of arrows 2, i.e., in the direction of advancement of the stream and the single layer 3). The second transporting unit 7 is installed upstream of a segregating unit 1 which is adjacent a third portion of the path, namely adjacent the path of the single layer 3 of the mixture of tobacco particles and foreign particles 17.

The first transporting unit 4 includes a vibratory conveyor 6 having a bottom wall provided with transversely extending steps 13 which cause successive increments of the multilayer stream to cascade along the downwardly sloping upper side of the bottom wall on their way toward the outlet A of the vibratory conveyor. The stream is showered onto or is otherwise delivered to the (upper) right-hand portion of the bottom wall of the conveyor 6.

The second transporting unit 7 comprises two belt or chain conveyors 8 and 9 which are disposed above and are spaced apart from each other to define an elongated channel or tunnel 11 between the lower reach of the endless flexible element (belt or chain) of the upper second conveyor 9 and the upper reach of the endless flexible element (belt or chain) of the lower second conveyor 8. At least a portion of the channel 11 (e.g., the portion adjacent the outlet A of the vibratory conveyor 6) can taper in the direction of arrows 2, i.e., the height of such portion of the channel decreases in the direction of advancement of tobacco particles and foreign particles beyond the outlet A. The second transporting unit 7 further comprises sidewalls 12 which flank the channel 11 (see also FIG. 2).

At least one pulley or sprocket wheel (shown but not referenced in FIG. 1) for the endless flexible element of the conveyor 9 is driven in synchronism with at least one pulley or sprocket ,wheel (shown but not referenced in FIG. 1) for the endless flexible element of the lower conveyor 8 so that the particles entering the channel 11 are advanced at a speed which is higher than the speed of advancement of successive increments of the stream or flow along the bottom wall of the vibratory conveyor 6. For example, the speed of advancement of particles along that (second) portion of the path which is defined by the channel 11 can be several times (e.g., five times) higher than the speed of advancement of tobacco particles along the bottom wall of the vibratory conveyor, i.e., along the first portion of the path. The means for driving the pulleys or sprocket wheels of the conveyors 8 and 9 can comprise a single prime mover (e.g., a variable-speed electric motor) or a discrete prime mover for each second conveyor.

The bottom wall of the vibratory conveyor 6 which is shown in FIG. 1 slopes downwardly in the direction of the arrows 2, e.g., at an angle of approximately 15° to the horizontal. As can be seen in FIG. 1, the bottom wall of the conveyor 6 is carried by leaf springs which are mounted on a base. The latter is pivotable in the frame of the transporting unit 4, for example, to an extent which is necessary to change the inclination of the bottom wall of the conveyor 6 through an angle of approximately 15° above or below the illustrated neutral or intermediate position of FIG. 1. A vibratory conveyor, means for agitating the conveyor, and means for supplying a continuous tobaccos stream to the conveyor are described and shown, for example, in U.S. Pat. No. 3,985,145 granted Oct. 12, 1976 to Broscheit et al. for "Method and apparatus for changing the moisture content of tobacco". The relevant passages of this patent are incorporated herein by reference.

FIG. 1 further shows that the upper reach of the endless flexible element of the second conveyor 8 also slopes downwardly in the direction of the arrows 2. This enhances the transfer of successive increments of the stream at the outlet A of the vibratory conveyor 6. For example, the upper reach of the endless flexible element of the conveyor 8 can slope downwardly at an angle of approximately 10°, i.e., at an angle such that the upper reach is inclined relative to the horizontal but at an angle less than the angle of the bottom wall of the vibratory conveyor 6.

The upper reach of the endless flexible element forming part of the lower conveyor 8 extends beyond the upper conveyor 9 of the transporting unit 7 and propels successive increments of the tobacco layer through a monitoring and expelling or ejecting station for the segregating unit 1. Tobacco particles of the single layer 3 are permitted to advance onto a take-off conveyor 19, and the detected foreign particles are segregated from the layer 3 and are propelled or otherwise advanced onto a further conveyor 21. The illustrated segregating unit 1 includes a battery of conventional laser detectors 14 above a reference drum 16. The color of the peripheral surface of the drum conforms to or is otherwise related to the color of the tobacco particles so that the detectors 14 can discriminate between radiation which is reflected by tobacco particles and by the drum 16 on the one hand, and the radiation reflected by foreign particles. The detectors 14 transmit signals to a conventional image processing unit (not shown) which, in turn, transmits signals to one or more nozzles 18 of a row of nozzles extending transversely across the path of the single layer 3 and serving to expel foreign particles from the layer toward and onto the conveyor 21. Thus, the processor transmits signals which are indicative of the positions of detected foreign particles in the layer 3 so that such particles are expelled but the satisfactory tobacco particles are free to advance toward and onto the conveyor 19.

Figure 2:
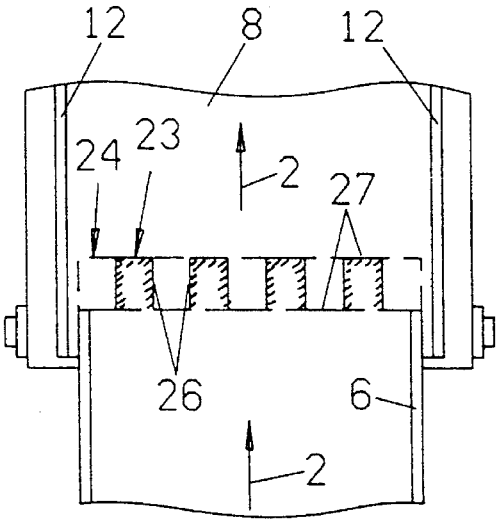
FIG. 2 is a fragmentary plan view of a first embodiment of the outlet of the vibratory conveyor.

The details of one presently preferred construction of the outlet A of the vibratory conveyor 6 are shown in FIG. 2. This outlet overlies the receiving end of the conveyor 8 and its square or rectangular teeth or prongs 23 are flanked by two rows of parallel edge faces 27 which extend transversely of the direction of advancement of tobacco particles,, and a row of edge faces 26 which extend in the direction of the arrows 2, namely each edge face 26 extends between an upstream edge face 27 and a downstream edge face 27 (as seen in the direction of the arrows 2). The reference character 24 denotes by broken lines the substantially rectangular region of descent of successive increments of the tobacco flow from the oscillating bottom wall of the vibratory conveyor 6 onto the upper reach of the endless flexible element of the conveyor 8.

The width of each tooth or prong 23 (as measured in a direction transversely of the direction indicated by the arrows 2) can exceed or can be less than the width of the spaces between neighboring teeth of the illustrated row of teeth 23.

When the bottom wall of the conveyor 6 is oscillated or vibrated to advance tobacco particles toward and beyond the outlet A, the particles can descend onto the conveyor 8 along the upstream and downstream edge faces 27 as well as along the edges faces 26 each of which extends between a front or downstream edge face 27 and a rear or upstream edge face 27. This results in a planar distribution of tobacco particles on the upper reach of the endless flexible element of the conveyor 8 and such particles are advanced to enter the upstream end of the channel 11. Otherwise stated, the particles which are discharged from the outlet A during successive forward movements of the bottom wall of the conveyor 6 descend toward and are intercepted by the conveyor 8 in such a way that, due to the fact that the conveyors 8, 9 advance the particles at a speed greater than that along the bottom wall of the conveyor 6, the particles on the conveyor 8 form a single layer wherein all of the foreign particles 17 can be readily detected and segregated by the unit 1 in the path portion downstream of the transporting unit 7. FIG. 2 further shows that the width of the path portion between the sidewalls 12 of the transporting unit 7 can exceed the width of the bottom wall of the vibratory conveyor 6.

Figure 3:
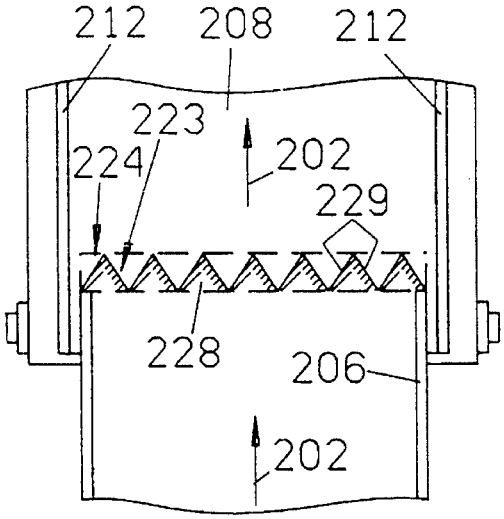
FIG. 3 is a similar fragmentary plan view of a modified outlet.

FIG. 3 shows a modified outlet which can be utilized in lieu of the outlet A shown in FIGS. 1 and 2. All such parts of the structure shown in FIG. 3 which are identical with or clearly analogous to the corresponding parts of the structure shown in FIG. 2 are denoted by similar reference characters plus 200. The outlet which is shown in FIG. 3 comprises a transversely extending row 228 of triangular prongs or teeth 223 having edge faces 229 which converge toward each other in the direction indicated by the arrows 202, i.e., in the direction of advancement of tobacco particles and foreign particles (if any) from the vibratory conveyor 206 onto the conveyor 208 of the second transporting unit. When the conveyors 206 and 208 are driven and the vibratory conveyor receives a stream or shower of tobacco particles in a direction substantially at right angles to the plane of FIG. 3, the edge faces 229 of the triangular teeth 223 cause tobacco particles to descend during each forward stroke of the bottom wall of the conveyor 206 so that the teeth 223 establish a substantially rectangular region 224 of descent of tobacco particles and foreign particles onto the upper reach of the endless flexible element of the conveyor 208. It has been found that, though the configuration of the prongs or teeth 23 is different from that of the prongs or teeth 223, the formation of a single layer of tobacco particles and other particles (if any) on the conveyor 208 is just as satisfactory as on the conveyor 8.

Figure 4:
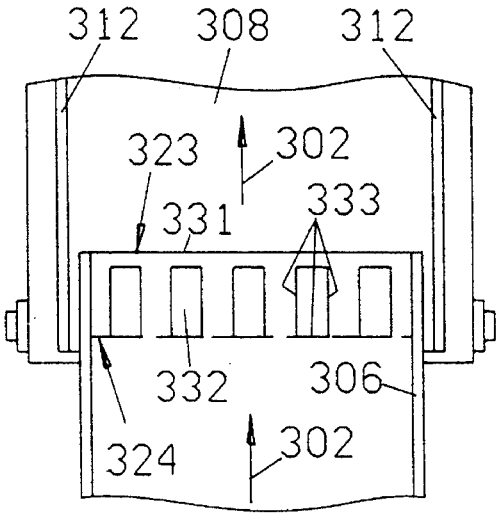
FIG. 4 is a similar fragmentary plan view of a third outlet.

All such parts of the structure shown in FIG. 4 which are identical with or clearly analogous to the corresponding parts of the structure shown in FIG. 2 are denoted by similar reference characters plus 300. The foremost portion 323 of the bottom wall of the vibratory conveyor 306 has a continuous transversely extending front edge face 331 located slightly downstream of several sets of additional edge faces 333 bounding elongated rectangular openings or slots 332 of the bottom wall. The openings 332 form a row which is parallel to the edge face 331.

When the vibratory conveyor 306 and the conveyor 308 are driven, particles of tobacco and foreign particles (if any) are caused to advance beyond the front edge face 331 as well as beyond the sets of four edge faces 333 surrounding each opening 332. The profile of the descending flow of particles is denoted by the broken line 324. Such discharge of particles beyond the bottom wall of the conveyor 306 again results in the formation of an at least nearly continuous single layer of particles on the upper reach of the endless flexible element forming part of the conveyor 308.

Figure 5:
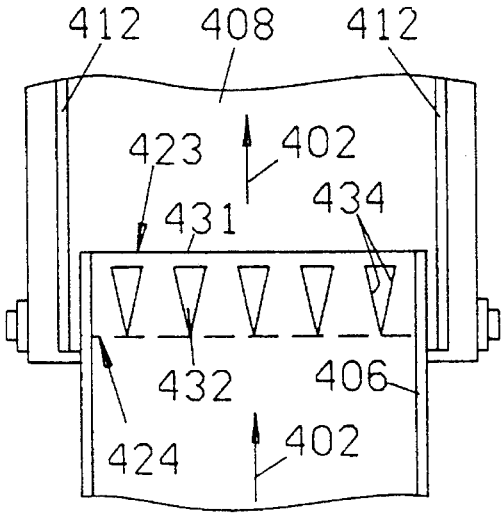
FIG. 5 is a similar fragmentary plan view of a fourth outlet.

All such parts of the structure shown in FIG. 5 which are identical with or clearly analogous to the corresponding parts of the structure shown in FIG. 2 are denoted by similar reference characters plus 400. The only difference between the outlets of FIGS. 4 and 5 is that the bottom wall of the vibratory conveyor 406 is provided with a row of triangular openings 432 each bounded by three edge faces 434 two of which converge toward each other in a direction counter to that indicated by the arrows 402. When the conveyors 406 and 408 are driven, particles of tobacco and foreign particles (if any) advance onto the conveyor 408 in part by moving beyond the transversely extending edge face 431 and in part by moving beyond the edge faces 434 bounding the openings 432. The profile of the descending particles which come to rest on the conveyor 408 is shown at 424.

The mode of operation of the apparatus embodying the transporting units 4, 7 and the segregating unit 1 of FIGS. 1 and 2 is as follows:

A shower or mass of tobacco particles in random distribution with foreign particles is delivered onto the bottom wall of the vibratory conveyor 6, preferably in such a way that the stream which develops on the bottom wall extends at least substantially across the entire bottom wall. The means for delivering tobacco particles onto the bottom wall of the conveyor 6 can include or constitute a so-called elevator conveyor which is utilized in distributors (also called hoppers) serving to deliver tobacco particles to the rod forming stations of cigarette making machines. The bottom wall of the conveyor 6 is oscillated back and forth to advance the tobacco particles in the direction of arrows 2, and such oscillatory movements take place simultaneously with the cascading of tobacco particles over the steps 13 in the bottom wall of the conveyor. Such agitation of tobacco particles results in separation of initially coherent particles (i.e., in breaking up of clumps of tobacco particles) as well as in uniform distribution of loosened particles all the way across the bottom wall of the conveyor 6. The distribution of particles and the resulting homogenization of the stream on the bottom wall of the conveyor 6 take place in as well as transversely of the direction indicated by the arrows 2.

The particles which descend onto the upper reach of the endless flexible element forming part of the conveyor 8 are subject to abrupt acceleration with the result that the particles of the layer on the conveyor 8 are spread out in the direction indicated by the arrows 2. In other words, any overlapping of particles in the direction of forward movement of the tobacco particles is eliminated so that the individual particles of the thus obtained single layer of particles can be readily detected during advancement between the discharge end of the conveyor 8 and the conveyor 19, i.e., between the detectors 14 and the drum 16. The intake end of the channel 11 draws air from the surrounding atmosphere and the resulting flow of a body of air in the direction of the arrows 2 ensures that the particles descending from the outlet A of the conveyor 6 are more rapidly and practically instantaneously compelled to advance at the speed of the upper reach of the belt or chain forming part of the conveyor 8. The beneficial effect of air entering the inlet of the channel 11 and flowing toward the segregating unit 1 is felt irrespective of the difference between the speed of tobacco particles advancing along the bottom wall of the vibratory conveyor 6 and the speed of particles advancing with the upper reach of the endless flexible element of the conveyor 8.

The segregating unit 1 can readily detect and expel all foreign particles 17, or at least those foreign particles which would be likely to affect the appearance and/or the quality of rod-shaped articles including a filler containing tobacco particles descending onto the conveyor 19. The signals which are furnished by the detectors 14 enable the aforementioned processor to actuate the corresponding nozzle or nozzles 18 so that the jets of compressed air issuing from the activated nozzles 18 reliably expel the detected foreign particles 17 on their way from the discharge end of the conveyor 8 onto the conveyor 19. If the jets of compressed air issuing from activated nozzles 18 happen to expel foreign particles 17 together with certain neighboring tobacco particles, the material which gathers on the conveyor 21 is subjected to one or more classifying actions, e.g., by conveying such material across one or more curtains of compressed air which propel the lighter tobacco particles in a desired direction but permit the normally heavier foreign particles to travel across the curtain or curtains to a collecting receptacle, not shown. The recovered tobacco particles can be returned into the shower of tobacco particles descending onto the upstream end of the bottom wall of the vibratory conveyor 6.

The aforedescribed combination of a vibratory conveyor 6 with one or more second conveyors 9 or 8 which can advance the particles at a speed exceeding, and preferably greatly exceeding, the speed of advancement of the particles along the bottom wall of the conveyor 6, has been found to be capable of ensuring the segregation of foreign particles from a body of tobacco particles advancing at a rate which is necessary to meet the requirements of modern high-speed cigarette makers or other machines for the production of rod-shaped articles of the tobacco processing industry. As already mentioned above, the speed at which the particles are advanced by the conveyor 8 can be several times (such as five times) the speed of particles advancing toward the channel 11 between the conveyors 8, 9 of the second transporting unit 7. As also mentioned above, the vibratory conveyor 6 causes the clumps (if any) of particles to be broken up and further causes the particles to spread out uniformly in and transversely of the directions indicated by the arrows 2. The rapidly moving conveyors 8 and 9 cooperate to ensure that the homogenized and spread out layer or layers of particles are spread out in the direction of the arrows 2 to reliably form a single layer 3 which can be relieved of foreign particles 17 on its way from the conveyor 8 onto the conveyor 19.

The outlets which are shown in detail in FIGS. 2, 3, 4 and 5 can be utilized with advantage in the improved apparatus as well as in vibratory conveyors which form part of or are combined with conventional apparatus for transporting tobacco particles. In other words, the features which were described with reference to FIGS. 2 to 5 are believed to be patentable in conjunction with other constituents of the improved apparatus as well as per se, i.e., irrespective of the nature of apparatus in which a vibratory conveyor employing an outlet of the type shown in FIGS. 2 to 6 or an analogous outlet is being put to use. An advantage of a conveyor embodying an outlet of the type shown in FIG. 2, 3, 4 or 5 is that it ensures the formation of a desirable single layer of tobacco particles on the conveyor 8 in spite of the fact that the bottom wall of the conveyor 6 moves back and forth in and counter to the direction indicated by the arrows 2 whereas the conveyor 8 is constructed and assembled to move the upper reach of its endless flexible element only in the direction which is indicated by the arrows 2 and at a much higher speed than the speed of particles advancing toward and beyond the outlet A of the conveyor 6. Otherwise stated, the outlet A renders it possible to fill the gaps which would normally develop between successive increments of the layer of tobacco particles on the conveyor 8 in view of intermittent discharge of successive increments of the tobacco layer or layers advancing along the upper side of the bottom wall of the conveyor 6. Even if the increments of the flow advancing along the upper side of the bottom wall of the conveyor 6 form a plurality of superimposed layers of particles which overlap each other in the directions indicated by the arrows 2, the particles which descend onto the conveyor 8 are reliably caused to form a single layer of particles which are located next to (rather than on top of) each other not only in the direction indicated by the arrows 2 but also at right angles to such direction. Thus, the outlet A renders it possible to convert a beam-like accumulation of tobacco particles into a single layer of particles which do not overlie each other in and/or transversely of the direction indicated by the arrows 2.

The outlets which are shown in FIGS. 2 and 3 are designed to discharge particles only at the very downstream end of the bottom wall of the conveyor 6 or 206, namely only beyond the edge faces of the teeth or prongs 23 or 223. Thus, the downsteam end of the bottom wall of the conveyor 6 or 206 can be said to resemble a rake or a comb having forwardly extending prongs or teeth bounded by edge faces along which the particles advance beyond the vibratory conveyor. In addition, the outlet A is designed to permit advancement of particles beyond the transversely extending upstream edge faces 27 which extend behind the spaces between neighboring prongs or teeth 23.

The aforediscussed configuration of the outlets shown in FIGS. 2 to 5 is particularly effective in combination with the feature that the bottom wall of the conveyor 6 slopes downwardly toward the conveyor 8 of the transporting unit 7 as well as with the feature that the bottom wall of the conveyor 6 is provided with steps 13 which enhance the disintegration of clumps of interlaced or coherent particles and promote spreading of the particles all the way across the bottom wall carrying the steps.

Figure 6:
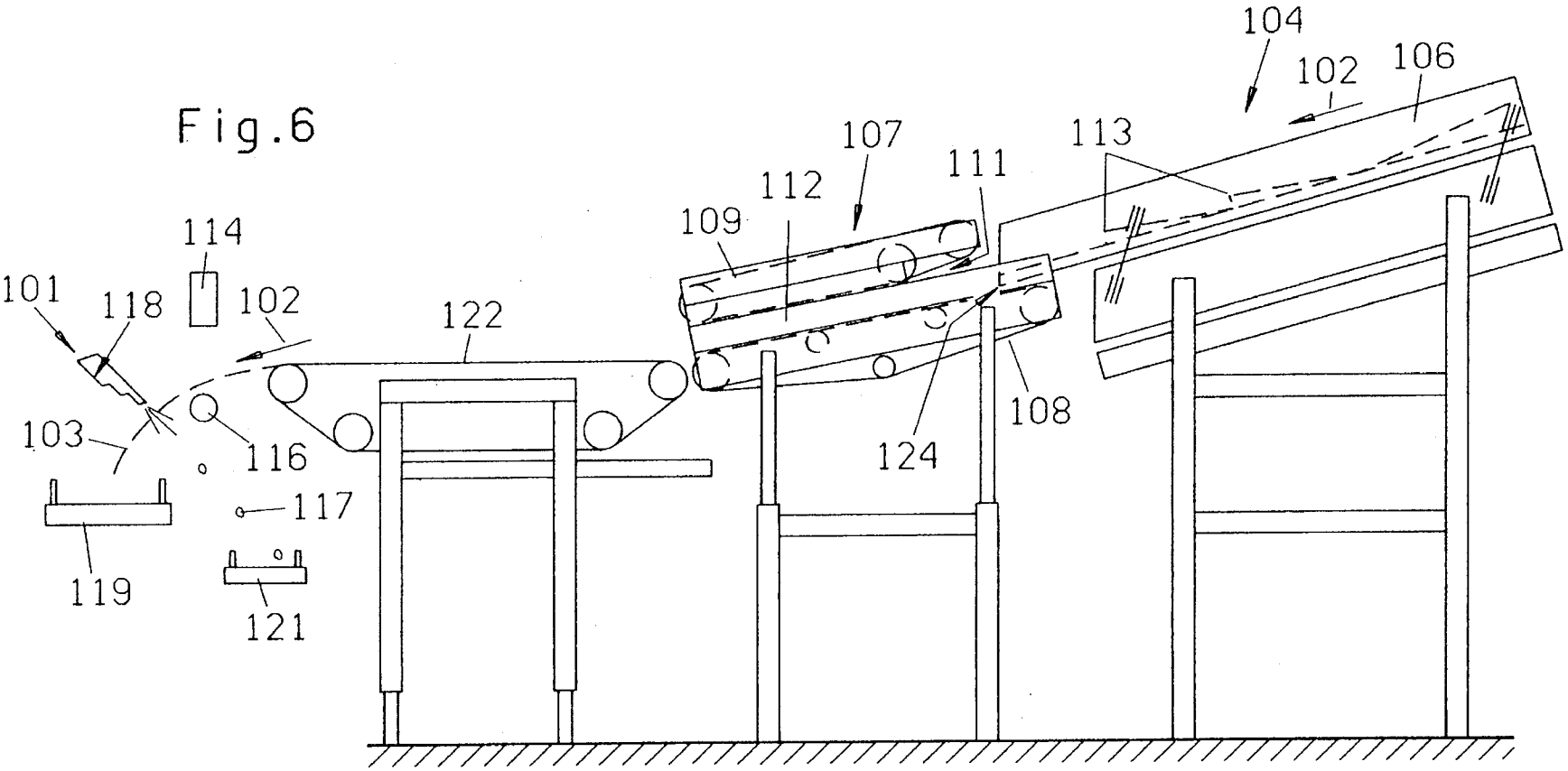
FIG. 6 is a schematic side elevational view of an apparatus with three transporting units.

FIG. 6 shows a modified apparatus. All such parts of this apparatus which are identical with or clearly analogous to the corresponding parts of the apparatus shown in FIG. 1 are denoted by similar reference characters plus 100. The main difference between the two apparatus is that the apparatus of FIG. 6 comprises a third transporting unit between the second transporting unit 107 and the station for the segregating unit 101. The illustrated third transporting unit includes a conveyor 122 having an endless flexible element (e.g., a chain or a belt) with an at least substantially horizontal upper reach .adjacent a portion of the path for the particles of tobacco and foreign particles downstream of the channel 111 between the conveyors 108, 109 of the transporting unit 107. At least one of the illustrated pulleys or sprocket wheels of the conveyor 122 drives the endless flexible element at a speed which is the same as but preferably less than the speed of the endless flexible element of the conveyor 108. Such selection of the speed of the endless flexible element of the conveyor 122 has been found to contribute to even more satisfactory distribution of tobacco particles and foreign particles (if any) in that portion of the path for the single layer 103 which extends between the conveyor 122 and the conveyor 119. The conveyor 122 can shorten the distances between the particles in the stream 103, i.e., the single layer 103 is condensed as seen in the direction of the arrows 102. It has been found that a condensation of the single layer 103 in the direction of the arrows 102 facilitates the detection and segregation of relatively small foreign particles. The speed of the conveyor 122 is sufficiently high to ensure that the resulting single layer 103 contains a large number of discrete coplanar particles which advance toward and through the station for the segregating unit 101.

An important advantage of all of the aforedescribed embodiments of the improved apparatus is that they ensure the formation of a single layer of randomly distributed tobacco particles and foreign particles which can be readily monitored by existing segregating units for the purpose of expelling all or practically all undesirable foreign particles.

Another important advantage of the improved apparatus is that they can transport the particles at a rate which suffices to satisy the requirements of modern high-speed tobacco processing machines.

A further advantage of the improved apparatus is that they deliver to the segregating unit a single layer of particles wherein the foreign particles are detectable and can be readily expelled by available segregating units irrespective of the size, shape and/or composition of such particles.

The illustrated segregating unit 1 including laser detectors 14, a reference drum 16, nozzles 18 and an image processing unit, is available under the trade name "Tobaccoscan 6000" and is manufactured by the firm "Elbicon N.V., Belgium".

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

What is claimed is:

1. Apparatus for transforming a multilayer stream of tobacco particles into a single layer during advancement of the particles in a predetermined direction along an elongated path, comprising a first transporting unit including at least one vibratory first conveyor having means for advancing the particles at a first speed along a first portion of said path; and a second transporting unit located downstream of said at least one first conveyor and included two second conveyors having means for advancing the particles at a second speed higher than said first speed along a second portion of said path, said second conveyors being disposed one above the other and defining an air-confining channel for the advancement of particles along said second portion of said path, said second conveyors including endless flexible elements one of which includes an upper reach below and the other of which includes a lower reach above said channel.

2. The apparatus of claim 1, wherein said at least one first conveyor is located upstream of said at least one second conveyor and includes or constitutes a vibratory conveyor.

3. The apparatus of claim 1, wherein said at least one second conveyor is located downstream of said at least one first conveyor and includes at least one endles flexible element.

4. The apparatus of claim 1, wherein said at least one first conveyor is located upstream of said at least one second conveyor and comprises or constitutes a vibratory conveyor, said at least one second conveyor comprising at least one endless flexible element.

5. The apparatus of claim 1, wherein said at least one first conveyor includes a vibratory conveyor located upstream of said at least one second conveyor and having a multifaced outlet for delivery of particles to said at least one second conveyor.

6. The apparatus of claim 5, wherein said outlet comprises at least one first face, at least one second face located downstream of said at least one first face, and at least one third face between said at least one first face and said at least one second face.

7. The apparatus of claim 5, wherein said outlet includes an array of faces extending substantially transversely of said direction.

8. The apparatus of claim 7, wherein said outlet includes a row of neighboring teeth having edge faces together constituting said array.

9. The apparatus of claim 7, wherein said outlet comprises a plurality of prongs having edge faces together constituting said array.

10. The apparatus of claim 9, wherein said edge faces include edge faces extending in said direction and edge faces extending transversely of said direction.

11. The apparatus of claim 9, wherein said edge faces include pairs of edge faces converging toward each other in said direction.

12. The apparatus of claim 5, wherein said outlet includes an edge face; extending transversely of said direction and a plurality of additional edge faces bounding openings provided in a bottom wall of said vibratory conveyor upstream of said transversely extending edge face.

13. The apparatus of claim 12, wherein said openings form a row extending transversely of said direction upstream of said transversely extending edge face.

14. The apparatus of claim 12, wherein at least some of said openings have a substantially square or rectangular outline.

15. The apparatus of claim 12, wherein the edge faces bounding said openings include pairs of edge faces converging toward each other counter to said direction.

16. The apparatus of claim 1, wherein said at least one first conveyor includes a vibratory conveyor having a bottom wall sloping downwardly in said direction.

17. The apparatus of claim 16, wherein said vibratory conveyor further comprises means for varying the slope of said bottom wall within a range of approximately 15° above and below a neutral position.

18. The apparatus of claim 1, wherein one of said conveyors includes a vibratory conveyor having a plurality of steps which establish a cascading flow of particles along the respective portion of said path.

19. The apparatus of claim 1, wherein said second transporting unit further includes means for driving said one endless flexible element in synchronism with said other endless flexible element.

20. The apparatus of claim 1 for transforming a multilayer stream containing tobacco particles and foreign particles, further comprising means for segregating the foreign particles from the single layer in a third portion of said path downstream of said first and second portions.

21. The apparatus of claim 1, wherein said second portion of said path slopes downwardly and is disposed downstream of said first portion, and further comprising a third transporting unit adjacent a substantially horizontal third portion of said path downstream of said second portion.

22. The apparatus of claim 21, wherein said third transporting unit includes at least one third conveyor having means including at least one endless flexible element for advancing the particles at a third speed less than said second speed.

23. The apparatus of claim 1, wherein said second transporting unit further includes sidewalls flanking said channel and compelling an intake end of said channel to draw air from the surrounding atmosphere so that the thus drawn air compels the particles to advance at least substantially at the speed of at least one of said endless flexible elements.

* * * * *